US005181310A

United States Patent [19]

Josephson

[11] Patent Number: 5,181,310

[45] Date of Patent: Jan. 26, 1993

[54] METHOD OF MAKING A THREADED INSERT ASSEMBLY

[75] Inventor: Arnold Josephson, Greenlawn, N.Y.

[73] Assignee: Leviton Manufacturing Company, Inc., Little Neck, N.Y.

[21] Appl. No.: 841,235

[22] Filed: Feb. 24, 1992

Related U.S. Application Data

[63] Continuation of Ser. No. 683,404, Apr. 10, 1991, abandoned, which is a continuation of Ser. No. 542,865, May 23, 1990, abandoned.

[51] Int. Cl.[5] ..... B21D 39/00

[52] U.S. Cl. ..... 29/517; 29/520; 411/333; 411/334; 411/361; 470/2; 470/21; 470/25

[58] Field of Search ..... 29/437, 517, 520, 882; 10/152 R, 152 T; 411/333, 334, 361, 533

[56] References Cited

U.S. PATENT DOCUMENTS

| | | | |
|---|---|---|---|
| 2,205,871 | 6/1940 | Young | 10/152 X |
| 3,006,003 | 10/1961 | Johnson, Jr. | 29/517 X |
| 3,010,126 | 11/1961 | Wilcox | 10/152 R |
| 3,060,562 | 10/1962 | Fransson | 10/152 R |
| 4,261,402 | 4/1981 | Stanaitis | 411/533 X |

FOREIGN PATENT DOCUMENTS

| | | | |
|---|---|---|---|
| 2627313 | 1/1977 | Fed. Rep. of Germany | 10/152 R |

*Primary Examiner*—Carl J. Arbes
*Attorney, Agent, or Firm*—Paul J. Sutton

[57] ABSTRACT

A method of making a threaded insert assembly for sheet material wherein a threaded insert that is a single unitary element is installed in a closely fitting hole in the sheet material with its threads occupying the hole. The sheet material around the hole on the exit side of the material is then upset into the threads of the insert in order to hold it by its threads so that it is adjustable by rotation. An unthreaded tip effectively prevents removal of the insert by back-screwing.

5 Claims, 4 Drawing Sheets

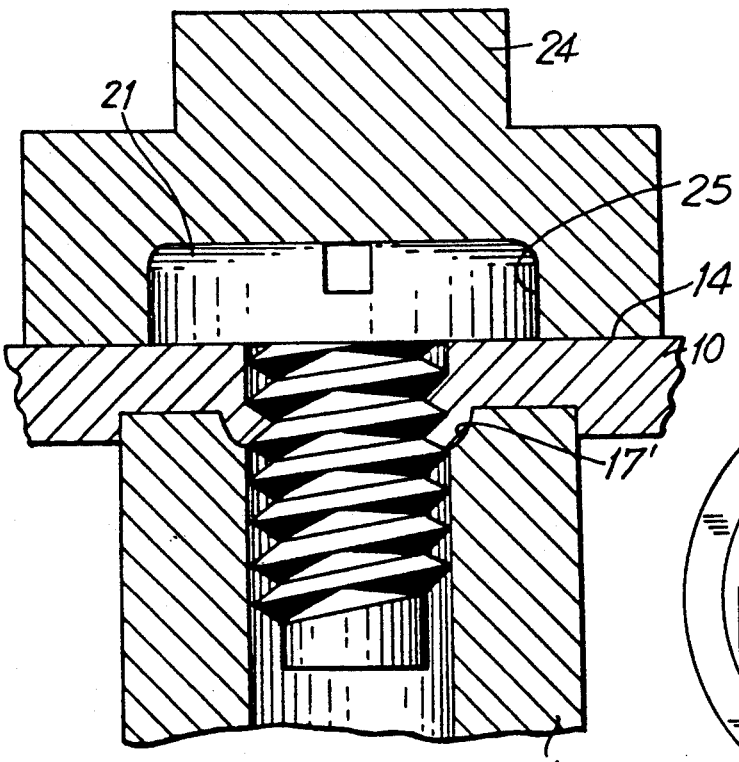
FIG. 9
FIG. 10
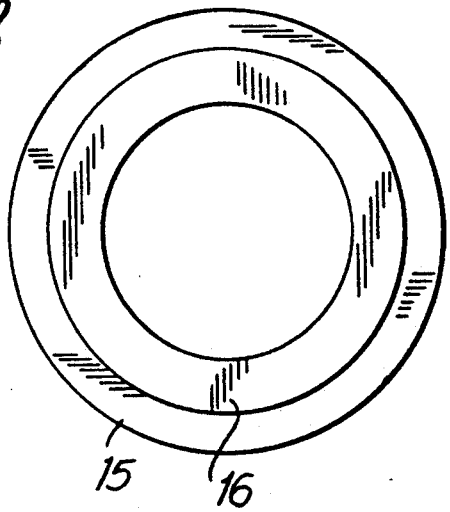
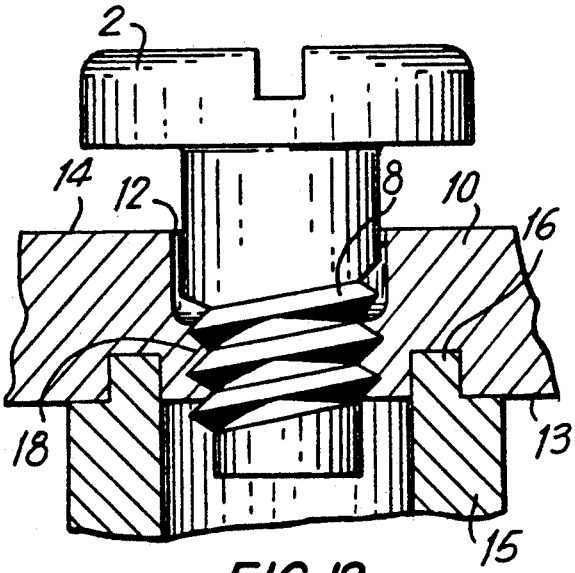
FIG. 12
FIG. 11
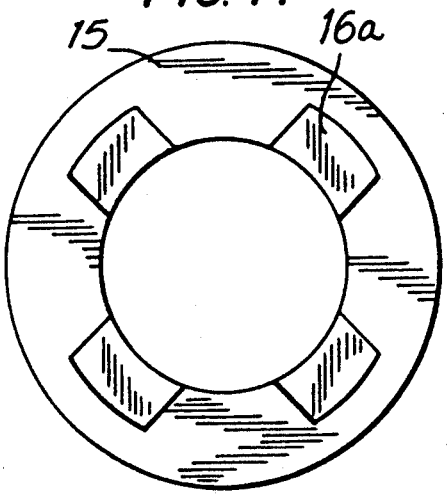

METHOD OF MAKING A THREADED INSERT ASSEMBLY

This is a continuation of application Ser. No. 683,404 filed Apr. 10, 1991, now abandoned which application was also a continuation of application Ser. No. 542,865 filed May 23, 1990, now abandoned.

BACKGROUND OF THE INVENTION

1. Field of the Invention

The present invention relates to a method of making an assembly. More particularly, the present invention is directed towards the method of making a threaded insert assembly wherein the insert's threads are captured and rotatably held after it is inserted, and further, where the insert cannot be removed by normal means after the capture.

2. Background of the Invention

There has been a long felt need, since the advent of multiple stamped assemblies which incorporate threaded inserts, to eliminate the need to attend to each threaded insert individually in order to insert and/or screw it into the stamping.

The present methods are characterized by being slow, costly, and are often labor intensive. For example at present, when screw-type wire fastener inserts are installed in electrical socket terminal strips which are stamped from sheet metal, either a self-threading type screw is used or most commonly the hole is tapped prior to screwing in a machine screw.

Terminal strips of the type described are usually stamped in complex strips having a plurality of repetitive configurations, each requiring one or more theaded inserts. Often each insert must be screwed to have its head within a specified distance from the strip to leave room for wire wrap as a convenience for the user. Finally, as an added convenience, or safety factor as the case may be, the tip of the insert is struck to deform the threads thereby providing a portion which resists accidental removal of the screw from the assembly.

It is quite apparent that either each fastener requires much manual attention during assembly or automation calls for relatively slow sequential installation or complicated and expensive machinery for simultaneous installation.

Another consideration in the aforedescribed stamped sheet metal assembly comes to point when the sheet metal is relatively thin. This consideration is retaining strength. Threads often strip when the fastener is put under load in use. This is often addressed by extruding the hole in which the fastener is installed, to form a circular flange, thereby increasing the thread holding area. The present invention operates to include this feature when advisable.

SUMMARY OF THE INVENTION

In view of the foregoing, it is one object of this invention to provide a method of making a threaded insert assembly which requires minimum manual attention to installation of the insert.

It is another object of the invention to provide a method of making a non-removable threaded insert assembly without the need for a post-installation thread distorting operation.

It is another object of the invention to provide a method of making a non-removable threaded insert assemby wherein the retaining portion of the insert is approximately equal to but not larger than the thread's major diameter.

It is yet another object of the invention to provide a method of making a threaded insert assembly for stamped material which has holding thread length greater than the thickness of the sheet metal and, which thus requires minimal manual attention to installation of the insert.

Other objects and advantages of the invention will become readily apparent to persons skilled in the art from the ensuing description.

Briefly, in accordance with the present invention, a threaded insert that is a single unitary element including a head on one end, a tip on the other and threads included between the head and tip is installed in a closely fitting hole in the sheet material. In one embodiment, the insert which may have been manufactured by rolling, for example, will have its tip left unthreaded by the operation so that it remains at the same diameter as the threads' major diameter.

The insert is installed so that its threads occupy the hole, and also, if desired so that its head is a specified distance from the entrance surface of the sheet material. If the unthreaded insert is used, the tip it is also arranged so that the tip extends beyond the exit surface of the sheet material.

The sheet material around the hole at the exit side of the material is then set into the threads of the insert in order to hold it by the threads so that it is adjustable by rotation. The unthreaded tip effectively prevents removal of the insert by back-screwing.

BRIEF DESCRIPTION OF THE DRAWINGS

FIG. 9 is a cross-sectional view of one embodiment of the invention using an anvil die.

FIGS. 10 and 11 are face views of a sleeve type punch used in the method of the invention.

FIG. 12 is a cross-sectional view of a threaded insert assembly with thick sheet material.

DETAILED DESCRIPTION OF THE INVENTION

Figure 1:
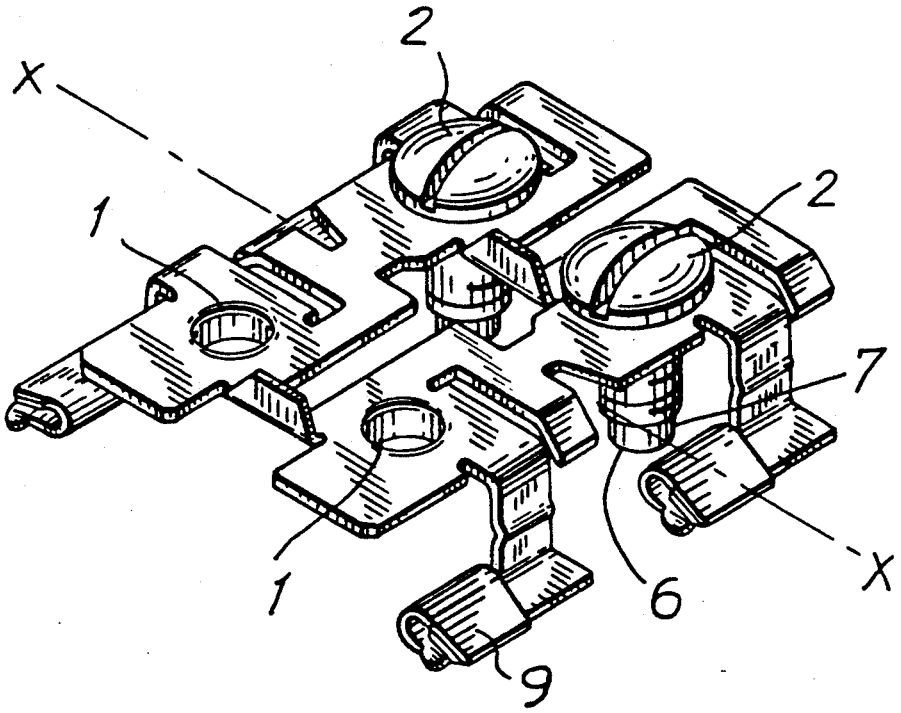
FIG. 1 is a perspective view of a repetitive configuration electrical terminal strip.

Turning now in more detail to the drawings, FIG. 1 shows a portion of a terminal strip stamping. The strip is of the type typically installed in a home 110 VAC two plug wall socket assembly. The strip's elements are stamped from sheet metal. Holes 1 are formed in the terminal strips during stamping to receive slotted screw type insert 2, two of which may be seen installed at the leading end of the strip in FIG. 1. In service, a portion of the strip comprising twin mirror image terminals is separated from the strip at X (FIG. 1) for mounting in the plug assembly (not shown).

Figure 2:
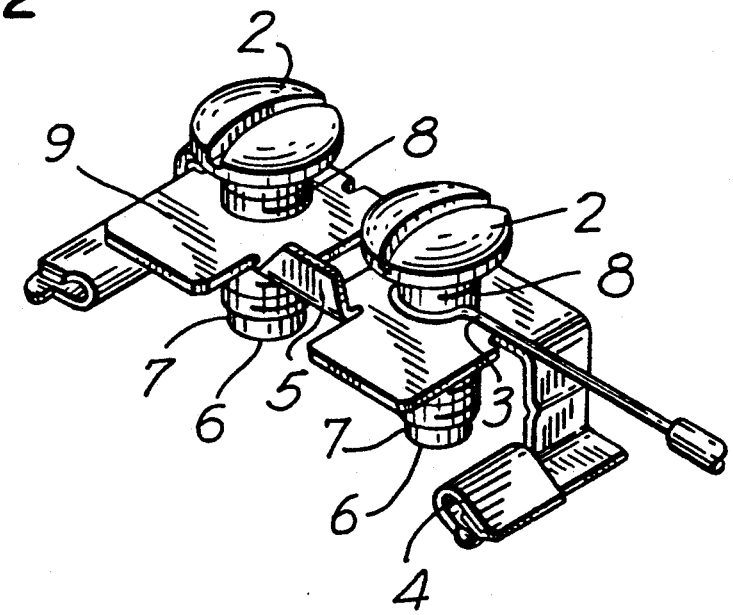
FIG. 2 is a perspective view of one section of the strip of FIG. 1.

The twin strip is typically presented to the user as shown in FIG. 2 when it is installed in the socket body.

The insert is provided partially withdrawn from the terminal to permit wrapping of user's wire 3 around the insert where upon the insert is tightened down on the wire for electrical connection and to securely retain it. In this particular strips application, folded portions 4 are one pole of the electrical contacts for two-prong electrical line plugs inserted in the socket. Tab 5 may be cut by the user to provide electrical isolation between the two sockets of the socket assembly in which the strip is mounted.

The tip 6 of insert 2 has a portion 7 of its length to which the threads do not extend, that portion having a diameter which is larger than the minor diameter of screw thread 8 of insert 2. As explanation of this new method continues, it will be made clear that one fastener assembly product manufactured by the method, uniquely comprising: a headed insert 2, with its over-minor-diameter threadless tip 6, completely mounted in a section of sheet metal, as illustrated by stamping 9 of FIG. 2, and held by threads in the sheet metal, with the head, threaded portion and unthreaded portion consisting of a single unitary element, is also unique to the method. The single unitary element threaded insert portion of this assembly will be designated 19 in later drawings for clarity.

Figure 3:
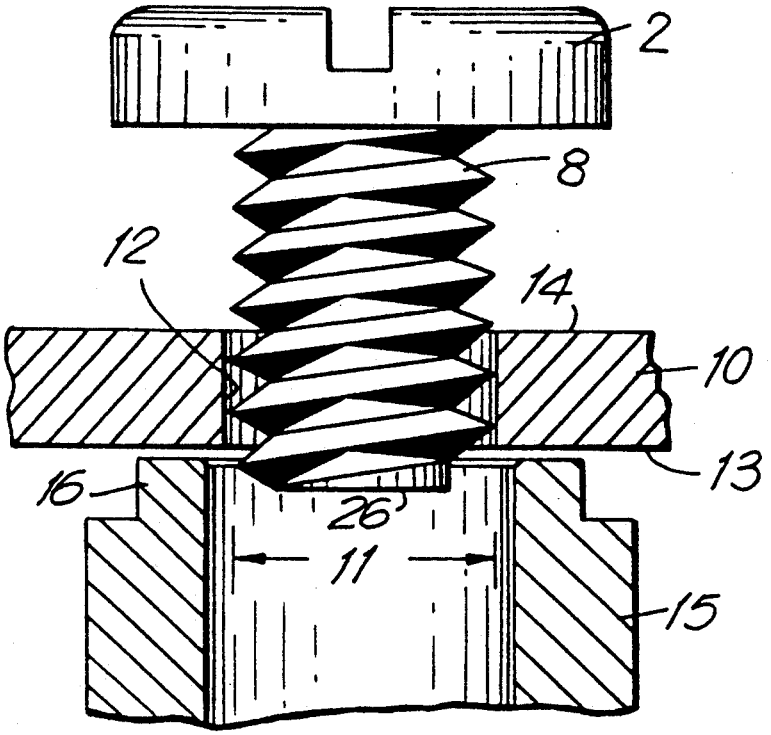
FIGS. 3 and 4 are cross-sectional views of a threaded insert assembly during fabrication stages.

For further detail, we will refer to FIG. 3 which shows a portion of a typical sheet metal assembly employing the method of the invention to provide a threaded insert assembly.

In one embodiment of the method, hole 1 is formed in sheet metal 10 by drilling, punching, stamping or other suitable conventional means. A threaded insert 2, with its threads 8 having a major diameter 11 less than but closely fitting to the inner diameter 12 of hole 1 is inserted into the hole in the sheet metal from the entrance surface 14 deep enough so that its threads occupy the hole.

In the example of FIG. 3, the end 26 of threads 8 extends below exit face 13 of the sheet metal.

Figure 4:
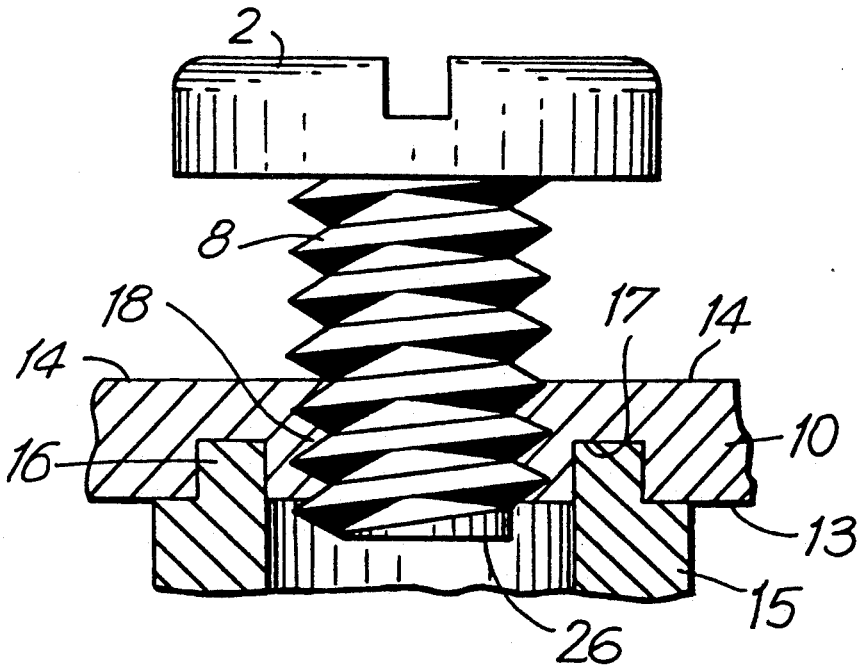
Figure 5:
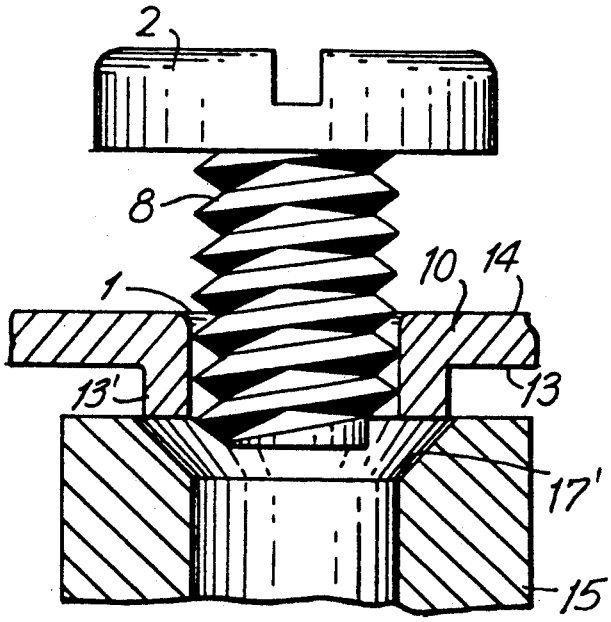
FIGS. 5 and 6 are cross-sectional views of a threaded insert assembly with circular flange reinforcement of the hole, during fabrication stages.

Sleeve punch 15 having circular flange 16 is impact driven into face 13 of the sheet metal, upsetting the metal and forcing it into the threads of insert 2. The result may be seen in FIG. 4 where indentation 17 is formed in sheet metal 10, forcing the material around and into the threads 8 of insert 2. Note that the circular flange design of punch 15 leaves planar the surface of face 13 which surrounds the hole. No material other than the insert protrudes above face 13. This has the advantage of permitting interference free fit between sheet metal face 13 and a supporting surface if so desired.

While circular flange 16, (FIG. 10) generates female fastener holding threads 18 completely around the fastener, in engagement with fastener threads 8, it is also within the contemplation of the invention to include generation of female threads intermittently around the screw in engagement with its threads. For that purpose, discontinuous circular flange 16*a*, FIG. 11, made in the form of lugs would be employed.

Figure 6:
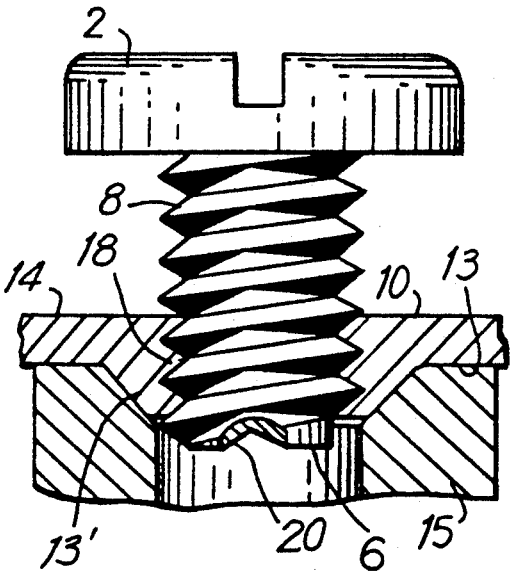

In another embodiment of the invention, hole 1 in sheet metal 10 may be formed with extruded shoulder 13' whereupon threads 8 of insert 2 are inserted into the hole to fill the hole to its full depth. For this hole design, sleeve punch 15 is provided with chamfer 17' which moves the sheet metal including that of the extruded portion into the thread of the insert thereby forming female thread 18 for holding the insert as described earlier and as may be seen in FIG. 6.

Newly formed female thread 18 extends the length of shoulder 13' thus providing a thread length that is greater than the thickness of sheet metal 10 to provide greater retention for the screw threads than possible with female threads having length equal to the thickness of the sheet metal.

After insert 2 is inserted in hole 1, so that its tip 6 is below exit surface 13 including any shoulder which may be formed of that surface, the tip may be staked at 20 to upset the threads and thereby provide resistance to backing out of the fastener when it is engaged with the female threads which may be formed either before or after the staking.

Figure 7:
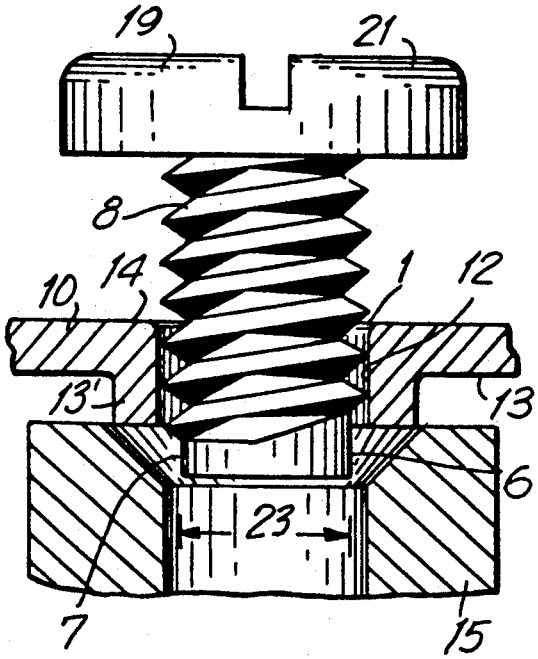
FIGS. 7 and 8 are cross-sectional views of a threaded insert assembly with circular flange reinforcement of the hole and retaining type tip configuration, during fabrication stages.
Figure 8:
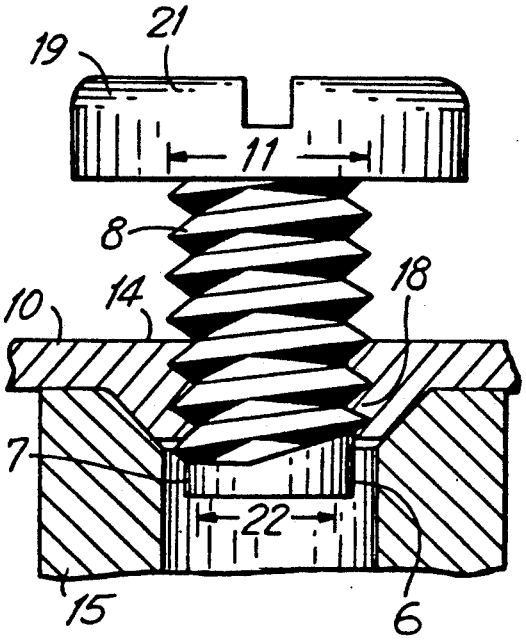

FIGS. 7 and 8 illustrate the method whereby the earlier described assembly with single integral unitary element threaded insert having unthreaded tip portion is formed. Referring to FIG. 7, single unitary element threaded insert 19 comprising of head 21, threaded portion 8 and unthreaded 23 tip 6 having an outer diameter which is larger than thread 8's minor diameter 22, is installed in hole 1 having an extruded shoulder 13'. The major diameter of thread 8 is smaller than but closely fitting to inner diameter 12 of hole 1.

The single unitary element threaded insert may be formed by machining or by rolling the threads and headed or slotted in the normal manner as in making threaded inserts such as slotted-head screws. When manufactured by rolling, the rolling die may be modified to form the thread only leaving the unthreaded tip of the screw with a diameter approximately equal to that of the threads' major diameter.

Once the insert is inserted with the unthreaded portion of tip 6 below exit surface 13 which comprises shoulder 13', punch 15 having chamfer 17' is impacted against the sheet metal to upset the material into the threads of the insert as described earlier.

The resulting assembly is illustrated in FIG. 8 wherein single unitary element threaded insert 19 is captured by female threads 18 of sheet metal 10 engaging fastener threads 8. Outer diameter 23 of the unthreaded portion 7 of tip 6 is approximately equal to the major diameter 11 of thread 8, effectively preventing deliberate or accidental removal of the fastener by unscrewing it from the sheet metal without incurring substantially higher unscrewing torque resistance and without damaging the thread.

For practical purposes, the fastener thread will be made harder than the sheet metal to avoid severe deformation of the thread when the sheet metal is upset into the thread by the punch.

It is within the contemplation of the invention that the insert assembly may be made in a plastic item wherein the sheet material or both the insert and sheet material may be made from plastics. In the case of the latter, the plastics are chosen so that they will not weld to each other. The sheet metal may be upset into the fastener's threads by impact or pressure and may be augmented by heat or ultrasonic energy.

It is also within the contemplation of the invention that oil may be applied to the insert's threads or to the hole before the metal moving operation to minimize cold welding and to ease rotation of the threaded insert.

In yet another embodiment of the invention, illustrated in FIG. 9, anvil die 24, having a recess 25 to hold fastener head 21, seats the head against entrance surface 14 of sheet metal 10 so that it serves as an anvil for sleeve punch 15 which includes chamfer 17' for upsetting the metal to form the threads as described earlier.

This facilitates simultaneous forming of a plurality of threaded insert assemblies in a single metal part such as stamping 9, FIGS. 1 and 2, described earlier.

When it is desired that the fastener be provided partially withdrawn for user convenience, as for the twin terminal strips described earlier, recess 25 may be designed to hold the insert by its head, partially withdrawn from the entrance surface 14 while it simultaneously serves as an anvil for the punch.

In another embodiment of the invention as shown in FIG. 12, the insert is inserted into relatively thick material wherein punch 15 upsets material to only about half of the depth of hole, forming female threads 18 about halfway to back to entrance surface 14 securely holding the insert by its threads 8. For this purpose, the fastener's threads need not occupy the full length of the hole before material upset in order to carry out the method of this invention. As illustrated in FIG. 10, threads 8 only need to be present in that portion of the hole where they will be expected to receive the upset material.

From the foregoing it will be seen that the invention provides a method of making a threaded insert assembly for sheet material which requires minimal manual attention to installation of the insert, provides a non-removable threaded insert assembly without the need for a post-installation thread distorting operation, and will provide the above advantages for thin as well as thick sheet material with reinforcement for use in high load applications.

Although the present invention has been described with respect to details of certain embodiments thereof, it is not intended that such details be limitations upon the scope of the invention except insofar as set forth in the following claims.

I claim:

1. A method of making a threaded insert assembly, which comprises:

forming an unthreaded through-hole into deformable material, inserting a threaded insert that is a single unitary element including a head on one end, a tip at the other and threads which stop short of the tip, the tip having a diameter which is larger than the threads' minor diameter, and approximately equal to but less than the threads' major diameter, into said unthreaded through-hole in said deformable material so that, a) the major diameter of the insert's threads and the inner diameter of the hole are closely received, b) the insert's threads, upsetting the material adjacent to the exit region of the hole so that said material moves into the threads located within the exit region of the hole for holding the insert by those threads wherein said insert in adjustable by rotating and restrained from withdrawal by the diameter of its tip.

2. The method of claim 1 wherein said upsetting of said deformable material is accomplished by driving the head of a sleeve-type punch into said material in close proximity to said hole.

3. A method for making a screw type wire fastener assembly for an electrical terminal strip of the type having a joined plurality of terminal sets, each comprising a fastener assembly, and a folded electrical contact portion connected to the fastener assembly for transferring electrical current between them, the fastener including a head at one end for fastening the wire to the terminal strip, a tip at the other end, and threads occupying a portion of its length, the method comprising:

forming the terminal strip with a hole for receiving the fastener, inserting the fastener in the hole so that its threads occupy the length of the hole, applying force to the terminal material around the hole to upset a portion of it into the fasteners' threads for holding the fastener by its threads so that it is adjustable by rotation, and forming said fastener in which the threaded portion of the fastener stops short of the tip, the tip diameter is approximately equal to but less than the major diameter of the threads and the fastener is inserted far enough into the hole so that the tip extends beyond the hole.

4. The method of claim 3 in which said applying of force to the terminal material is accomplished by driving the head of a sleeve-type punch into said material in close proximity to said hole.

5. A method of making a threaded insert assembly which comprises:

forming an unthreaded through hole with an extruded shoulder in a deformable material, inserting a threaded insert that is a single unitary insert including a head at one end and threads connected thereto into said hole to fill said hole to its full depth, and using a sleeve punch having a circular flange and a chamfer thereon which upsets said sheet metal including that of the extruded portion into the threaded insert whereby a female thread is formed in said material, thus holding said insert.

* * * * *